US008522400B1

(12) United States Patent
Jablonski

(10) Patent No.: US 8,522,400 B1
(45) Date of Patent: Sep. 3, 2013

(54) HINGE ASSEMBLY

(76) Inventor: Paul Jablonski, Jupiter, FL (US)

( * ) Notice: Subject to any disclaimer, the term of this patent is extended or adjusted under 35 U.S.C. 154(b) by 0 days.

(21) Appl. No.: 13/400,803

(22) Filed: Feb. 21, 2012

(51) Int. Cl.
*E05D 11/10* (2006.01)

(52) U.S. Cl.
USPC ..... 16/320; 16/352; 16/326; 16/327

(58) Field of Classification Search
USPC ..... 16/320, 326–328, 351, 352, 353, 16/380, 386, 230–232, 258, 262, 265, 270; 292/251.5, 253, 254, 106, 137, 341.15, 341.17, 292/359
See application file for complete search history.

(56) References Cited

U.S. PATENT DOCUMENTS

| | | | | | |
|---|---|---|---|---|---|
| 872,650 | A * | 12/1907 | Gilroy | 16/330 |
| 3,448,486 | A * | 6/1969 | Wright | 16/324 |
| 3,744,085 | A * | 7/1973 | Griego | 16/325 |
| 3,874,029 | A * | 4/1975 | McCullough | 16/329 |
| 4,384,375 | A * | 5/1983 | Gerome | 4/240 |
| 4,501,045 | A * | 2/1985 | Boyer | 16/331 |
| 4,844,519 | A * | 7/1989 | Dagon | 292/57 |
| 4,848,812 | A * | 7/1989 | Slaughter | 292/144 |
| 4,999,937 | A * | 3/1991 | Bechtold | 40/610 |
| 5,362,116 | A * | 11/1994 | Doyle et al. | 292/144 |
| 6,553,626 | B2 * | 4/2003 | Coburn | 16/386 |
| 7,000,290 | B1 * | 2/2006 | Ace | 16/386 |
| 7,610,684 | B2 * | 11/2009 | Steinich | 33/1 PT |
| 7,891,056 | B2 * | 2/2011 | McAfee | 16/374 |
| 2007/0157432 | A1 * | 7/2007 | Weinstein | 16/320 |
| 2010/0218344 | A1 * | 9/2010 | Van Gennep | 16/327 |
| 2011/0094058 | A1 * | 4/2011 | Van Gennep | 16/327 |
| 2011/0254285 | A1 * | 10/2011 | Hanchett, Jr. | 290/1 R |
| 2012/0066863 | A1 * | 3/2012 | Cayer | 16/230 |

FOREIGN PATENT DOCUMENTS

| | | | |
|---|---|---|---|
| FR | 2883903 | A1 * | 10/2006 |
| JP | 64001885 | A * | 1/1989 |

* cited by examiner

*Primary Examiner* — Chuck Y. Mah
(74) *Attorney, Agent, or Firm* — Thomas G. Scovone

(57) ABSTRACT

A hinge assembly is movable between an open position and a closed position and capable of being locked in an open position. The hinge assembly comprises first and second hinge members including, respectively, first and second body portions. The first and second body portions have aligned internal bores and a longitudinal axis about which the first and second hinge members rotate. A locking pin is movable within the hinge members' internal bores between a first position and a second position. When the locking pin is in the first position the hinge members cannot rotate relative to one another, and when the locking pin is in the second position hinge members can rotate relative to one another. A magnetic latch member is mounted to one of the hinge members to hold the locking pin in one of the first or second positions.

6 Claims, 4 Drawing Sheets

HINGE ASSEMBLY

BACKGROUND OF THE INVENTION

The present invention relates generally to hinges and, more particularly, to a hinge assembly useful in stopping or preventing the movement of a structure carried by the hinge or with which the hinge is operationally affixed. The present invention finds useful application with gates that form a part of the enclosure for swimming pools or other potentially hazardous sites, where building codes often require the use of self closing gates to minimize the hazard to children.

It is known in the art that such self closing gates pose an inconvenience in circumstances where continuing ingress and egress from the enclosed area is desired. For example, when a pool or yard is being serviced, the service personnel often have a need to enter and leave the area while carrying equipment and service implements. At such times, it is much more convenient to maintain the gate in an open position, and various devices have been proposed for this purpose. However, these prior devices suffer from a variety of disadvantages, such as cost, complexity, difficulty of installation and undesirable aesthetics. Many such prior art locking devices require modifications to the adjoining structures or walkways and may create some obstruction to the passageway serviced by the gate.

SUMMARY OF THE INVENTION

The present invention is directed to a device which addresses the above mentioned need, to maintain a self closing gate in an open position, while overcoming the disadvantages of the known prior art. The invention is directed to a simple, inexpensive, easily installed and aesthetically pleasing device which allows a self closing gate to be easily held in one or more open positions thereby facilitating passage into and out of the area enclosed by the gate and its associated fencing. When not in use, the device is inconspicuous and occupies no space or location which might prove inconvenient. In addition, no modifications to the surroundings, such as holes in adjacent walkways, are required.

The present invention is directed to a hinge assembly movable between open and closed positions and capable of being held or locked in an open position. The hinge assembly comprises a first hinge member including a generally cylindrical first body portion and a second hinge member including a generally cylindrical second body portion. The first and second body portions have a common longitudinal axis so that the first and second hinge members are rotatable to move the hinge assembly between the open and closed positions. The first and second body portions also have aligned internal bores with non circular cross section. A lock bar is movable within the internal bores of the first and second hinge members and has a cross section configured to engage the internal bores and prevent rotation of the hinge members. The lock bar is movable longitudinally within the internal bores of the first and second body members between a first position and a second position, so that when the lock bar is in the first position the first and second hinge members cannot rotate relative to one another and when the lock bar is in the second position the first and second hinge members can rotate relative to one another. A magnetic latch member is mounted to one of the first or second hinge members to hold the lock bar in one of the first or second positions.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENTS

Figure 1A:
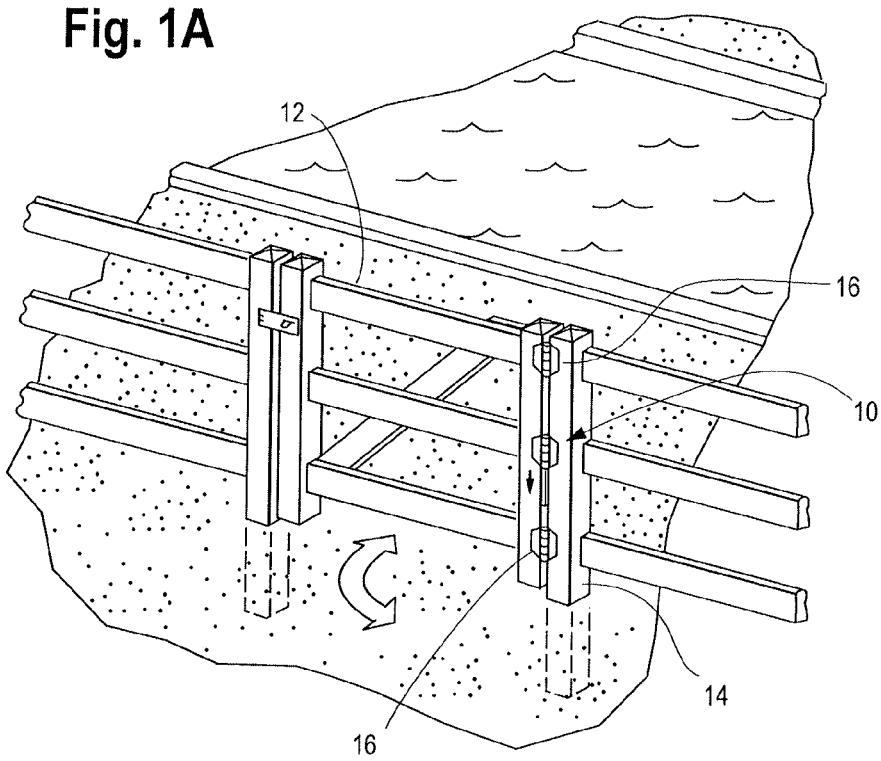
FIGS. 1A and 1B illustrate one preferred embodiment of the invention as used in a typical installation on a gate for a swimming pool enclosure.
Figure 1B:
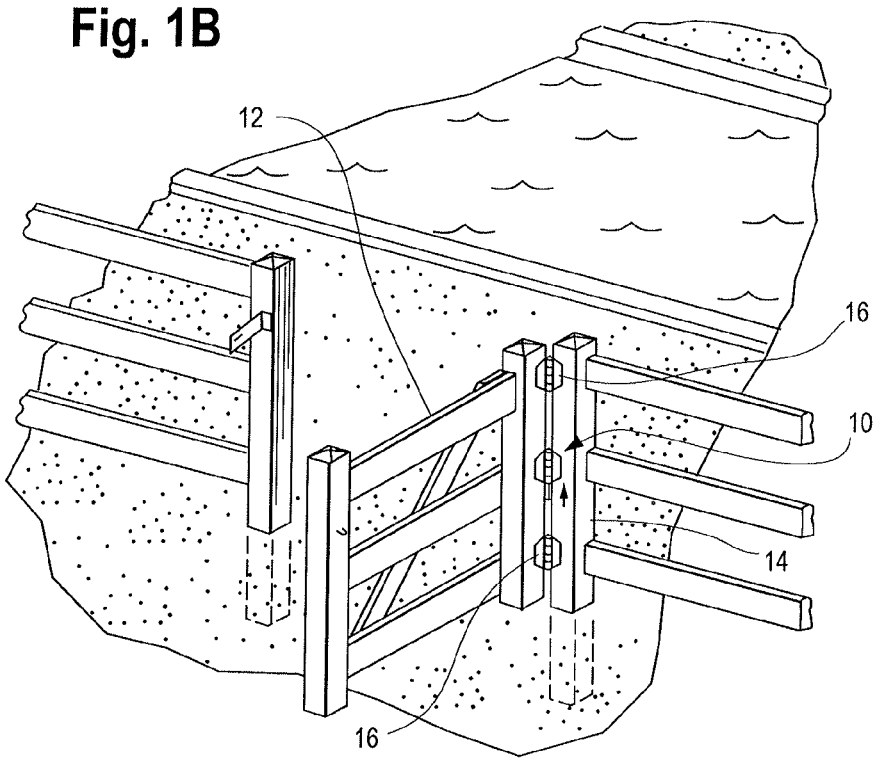
Figure 2:
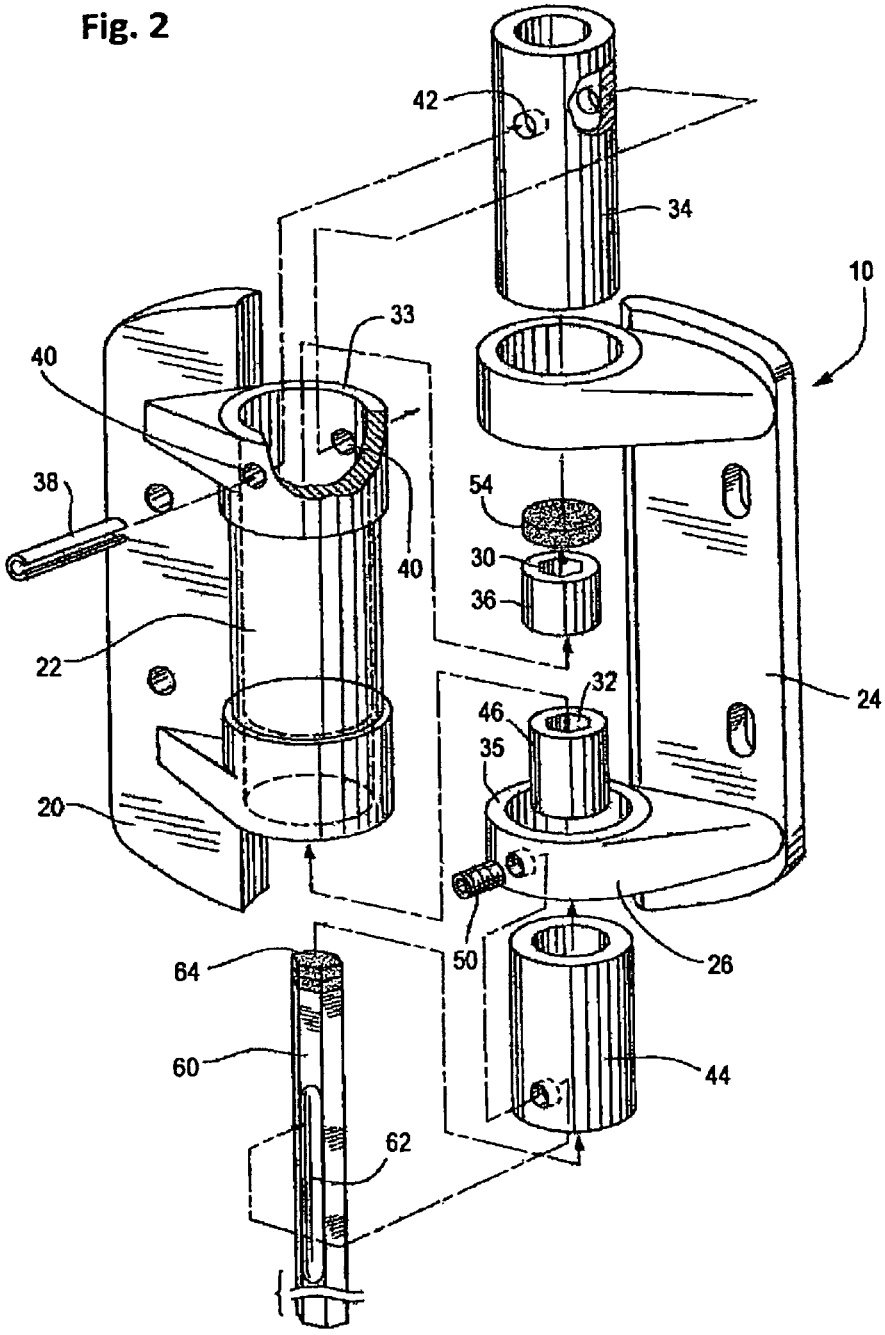
FIG. 2 is an exploded perspective view of one preferred embodiment of the invention showing the details of construction for various components of the hinge assembly.
Figure 3:
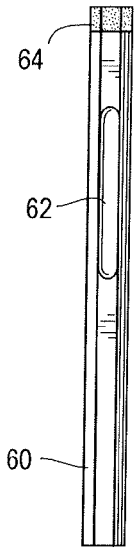
FIG. 3 is a side elevation view of the locking pin used in the embodiment shown in FIG. 2.
Figure 4:
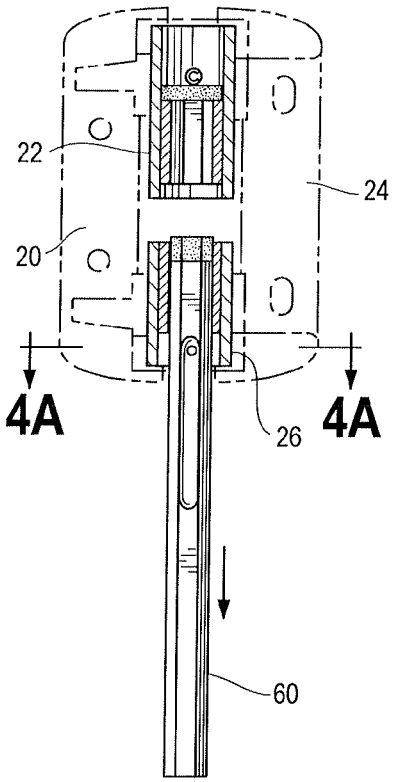
FIG. 4 is a partial cross sectional view illustrating the embodiment shown in FIG. 2 with the locking pin positioned to permit free rotation of the hinge assembly.

With reference to FIGS. 1A and 2A, a hinge assembly 10, made in accordance with one preferred embodiment of the present invention, is shown in a typical installation on a gate 12 forming part of an enclosure for a swimming pool. The gate 12 is mounted to a gate post 14 by hinge assembly 10 and self closing hinges 16. The self closing hinges include a spring biasing mechanism so that when the gate is opened it will automatically return to the closed position. The hinge assembly 10 includes components that allow the gate 12 and hinges 16 to swing freely to and from a closed position, shown in FIG. 1A, and an open position, shown in FIG. 1B. In addition, hinge assembly 10 includes components that, when actuated as discussed further below, will hold the gate 12 in the open position against the biasing forces of hinges 16. Of course, the invention may be used in other environments and with any structure where a need exists for maintaining the structure in a fixed rotational orientation.

With reference now to FIGS. 2-7B, the components used in the design of the preferred embodiments and their function will be explained. The hinge assembly 10 includes a first hinge member 20, having a generally cylindrical first body portion 22, and a second hinge member 24, having a generally cylindrical second body portion 26. In the illustrated embodiment, the second body portion 26 has spaced lower and upper segments positioned adjacent the bottom and top of the first body portion 22. The first and second body portions, 22 and 26, have a common longitudinal axis so that the first and second hinge members, 20 and 24, can rotate relative to one another to move the hinge assembly between open and closed positions. The body portions 22 and 26 also have internal bores 30 and 32 with non circular cross sections. In the illustrated embodiments, the body portion 22 comprises an outer cylindrical wall 33, a sleeve 34 and an insert 36. The insert 36 is configured with a hexagonal internal bore 30. The insert 36 is press fit into sleeve 34, and a retaining pin 38 is positioned within holes 40 and 42. As a result, the wall 33, sleeve 34 and insert 36 all rotate together. Likewise, the lower segment of body portion 26 comprises a cylindrical wall 35, a sleeve 44 and an insert 46. The insert 46 is press fit within sleeve 44 and configured with a hexagonal internal bore 32. A set screw 50 is located just below the insert 46 and fixes the position of sleeve 44 within wall 35. As a result, the wall 35, sleeve 44 and insert 46 all rotate together. In addition, the inside end of the set screw 50 extends into the internal bore 32 of insert 46. Those of skill in the art will appreciate that body portions 22 and 24, with non circular internal bores, may be fabricated in other ways, by molding or casting for example, and without need of separate sleeves and inserts.

A magnet 54 is housed within body portion 22 and held in place between pin 38 and insert 36. The function of magnet 54 will be described below.

A lock bar or rod 60 is employed with the hinge assembly 10 and may be positioned to prevent movement of, or lock, the first and second hinge members 20 and 24. The lock bar 60 is configured so that when inserted into the internal bores 30 and 32, it cannot rotate within the hinge members. In the illustrated embodiment, the lock bar 60 has a hexagonal cross section matching the cross sections of bores 30 and 32. In addition, lock bar 60 has a longitudinal guide groove 62 and one end 64 composed of a ferrous material. Lock bar 60 is positioned within insert 46 so that its guide groove 62 is aligned with set screw 50. The inside end of set screw 50 extends into guide groove 62 and acts as a guide pin to limit the longitudinal movement of the lock bar.

Figure 5:
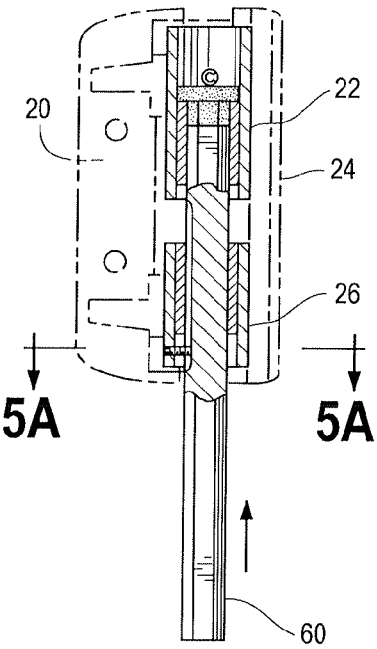
FIG. 5 is a partial cross sectional view similar to that of FIG. 4 but showing the locking pin positioned to prevent rotation of the hinge assembly.
Figure 4A:
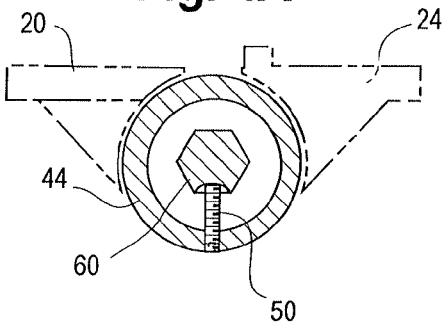
FIG. 4A is a cross sectional view taken along line 4A-4A of FIG. 4.
Figure 5A:
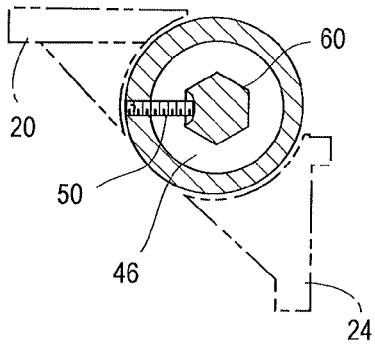
FIG. 5A is a cross sectional view taken along line 5A-5A of FIG. 5.
Figure 6:
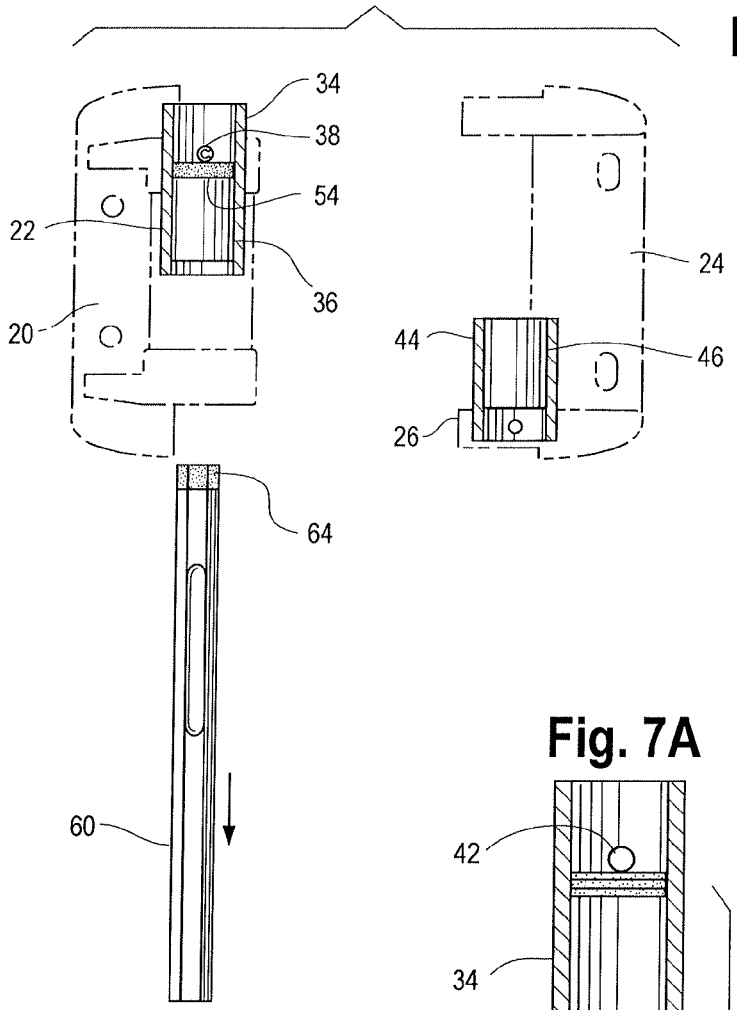
FIG. 6 is an exploded view in partial cross section illustrating certain internal design features of the embodiment shown in FIG. 2.
Figure 7A:
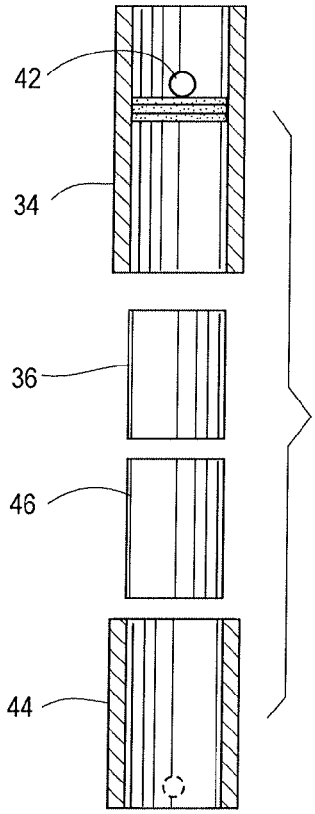
FIGS. 7A and 7B are exploded views in partial cross section again illustrating various internal design features of certain components used in the embodiment shown in FIG. 2.
Figure 7B:
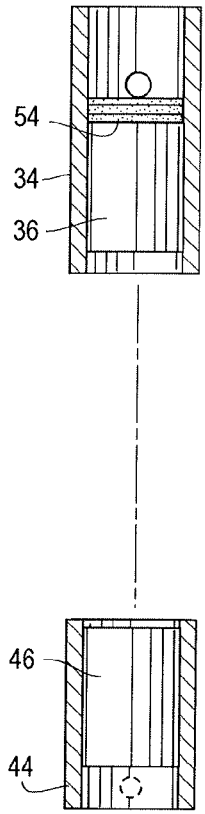

FIGS. 4, 4A, 5 and 5A show the operation of the preferred embodiment. When oriented vertically, gravity will act to displace the lock bar 60 to its lower position. With the set screw 50 engaging the uppermost end of guide groove 62, the lock bar 60 is held at this lower position. In this lower position, the lock bar 60 is completely disengaged from the internal bore 30 of the first body portion 22. When so arranged, the first hinge member 20 and second hinge member 24 are free to rotate, and the gate 12 (or other structure with which the hinge assembly 10 is associated) may swing freely. When the lock bar 60 is pushed up into the internal bore 30 of the first body portion 22 (as shown in FIG. 5), the two hinge members are locked or prevented from rotating relative to one another and the gate 12 is held in an open position. The magnet 54 attracts the ferrous end 64 of the lock bar to hold the lock bar in this upper position, maintaining the hinge assembly in the locked position. However, the lock bar may be easily pulled down to overcome this magnetic attraction, and the hinge assembly will once again be free to rotate, thereby allowing the gate to close. Alternatively, the magnet may be affixed to the end 64 of lock bar 60 and the disc 54 may be a ferrous alloy material to thereby provide the magnetic latching function.

While the hinge assembly 10 may be fabricated from a variety of materials, it is desirable that its components be made from plastics or metal alloys, such as stainless steel, which limit or eliminate oxidation.

It will be appreciated by those skilled in the art that various changes and modifications can be made to the illustrated embodiments without departing from the spirit of the present invention. For example, in the illustrated embodiment, the magnetic latch member holds the lock bar in the hinge locking position, but the lock bar might also be held in the hinge free rotation position, with the lock bar being pushed down to engage the locking position. Likewise, other means will be apparent to those skilled in the art to retain the lock bar within the hinge assembly. One alternative would include a radially extending element, such as a collar or other protuberance, on the lock bar which would engage a stop affixed to one of the hinge members to thereby limit the lock bar's longitudinal movement. Also, the disclosed embodiments show the hinge assembly 10 in use with two self closing hinges 16, and it is also apparent that the hinge 10 might be used with only one self closing hinge 16 or some other mechanism designed to bias the gate 12 toward the closed position. All such modifications and changes are intended to be covered by the appended claims.

I claim:

1. A hinge assembly movable between an open position and a closed position, the hinge assembly comprising:

a first hinge member including a first body portion, a second hinge member including a second body portion, the first and second body portions being pivotally connected to one another and having a common longitudinal axis so that the first and second hinge members are rotatable to move the hinge assembly between the open and closed positions, the first and second body portions also having aligned internal bores with a non circular cross section, a lock bar having a size and cross section adapted to engage the internal bores of the first and second hinge members, the lock bar being movable longitudinally between a first position and a second position, so that when the lock bar is in the first position, said lock bar engages said internal bores of the first and second body portions and the first and second hinge members are not rotatable relative to one another, and when the lock bar is in the second position, said lock bar disengages from one of the internal bores and the first and second hinge members can rotate relative to one another, and a magnetic latch cooperating between one of the first or second hinge members and the lock bar to hold the lock bar in one of the first or second positions.

2. The hinge assembly of claim 1 wherein said lock bar includes a longitudinally extending guide groove and one of said first or second body portions includes a guide pin which cooperates with the lock bar guide groove to limit the longitudinal movement of the lock bar.

3. The hinge assembly of claim 1 wherein said lock bar includes a radially extending element and one of said first or second body portions includes a stop which cooperates with the lock bar extending element to limit the longitudinal movement of the lock bar.

4. The hinge assembly of claim 1 wherein the magnetic latch comprises a magnetic disc mounted within the internal bore of one of the first or second body portions and said lock bar has one end composed of a ferrous material adapted to be held by said disc.

5. The hinge assembly of claim 1 wherein each of said first and second body portions comprises a cylindrical wall housing a sleeve and an insert defining the internal bore, and the wall, sleeve and insert are assembled to rotate together when the hinge assembly opens and closes.

6. The hinge assembly of claim 1 wherein the first and second hinge members are adapted to be mounted so that said longitudinal axis is oriented generally vertically, the first body portion is positioned above the second body portion, and the magnetic latch is mounted to the first body portion so that the lock bar is held magnetically in the first position to lock the hinge members to prevent rotation and the lock bar is movable downward away from the magnetic latch to the second position to permit the hinge members to rotate.

* * * * *